US005983817A

United States Patent [19]

Sekine

[11] Patent Number: 5,983,817

[45] Date of Patent: Nov. 16, 1999

[54] SEWING MACHINE CONTROL SYSTEM

[75] Inventor: Kiyokazu Sekine, Mie-ken, Japan

[73] Assignee: Brother Kogyo Kabushiki Kaisha, Aichi-ken, Japan

[21] Appl. No.: 09/177,158

[22] Filed: Oct. 22, 1998

[30] Foreign Application Priority Data

Oct. 24, 1997 [JP] Japan ..... 9-309716

[51] Int. Cl.[6] ..... D05C 5/02

[52] U.S. Cl. ..... 112/102.5; 112/470.04; 112/475.19; 364/470.09

[58] Field of Search ..... 112/470.04, 470.06, 112/102.5, 470.01, 475.01, 475.19, 475.05; 364/470.09, 470.07, 470.08

[56] References Cited

U.S. PATENT DOCUMENTS 4,104,976 8/1978 Landau, Jr. et al. ..... 112/470.02
5,284,104 2/1994 Hori et al. ..... 112/102.5
5,313,896 5/1994 Hashiride .

FOREIGN PATENT DOCUMENTS 5-76670 3/1993 Japan .
7-194880 8/1995 Japan .

*Primary Examiner*—Peter Nerbun
*Attorney, Agent, or Firm*—Kane,Dalsimer,Sullivan, Kurucz, Levy, Eisele and Richard, LLP

[57] ABSTRACT

A control system for a sewing machine, which is operable in a simulation manner as if the control system is connected to the sewing machine. When a sewing-machine control system starts a main control process, a status of its connection to a sewing machine is detected. If the connection is established, a connection flag is set. If it is not established, a connection flag is reset. A display device displays a menu select screen having a list of items, and a desired item is selected from the list. When the selected item is "Sewing process", the sewing-machine control device operates in the following manner. If the sewing-machine control device is not connected to the embroidering sewing machine, a virtual sewing-machine control program is executed to set "in-sewing" data for the pseudo status information, "0" as the initial value for a pseudo number-of-stitches; and "1800" for a pseudo rotation speed signal. The display device displays a pseudo sewing screen, constructed with those items of information.

20 Claims, 9 Drawing Sheets

1
10
11
CPU
12
ROM
13
RAM
14
DRIVE CKT
15
DRIVE CKT
16
DRIVE CKT
17
DRIVE CKT
18
DRIVE CKT
19
DRIVE CKT
20
DRIVE CKT
21
NEEDLE-BAR JUMPING SOLENOID
22
PRESSER FOOT SOLENOID
23
THREAD BREAKAGE SENSOR
24
COMMUNICATION I/F
25
MACHINE MOTOR
26
NEEDLE-BAR CHANGE MOTOR
27
X-AXIS DRIVE MOTOR
28
Y-AXIS DRIVE MOTOR
29
THREAD-CUTTING MOTOR
30
OPERATION PANEL
M1
M2
M6
L
2
SEWING MACHINE CONTROL DEVICE

FIG.3

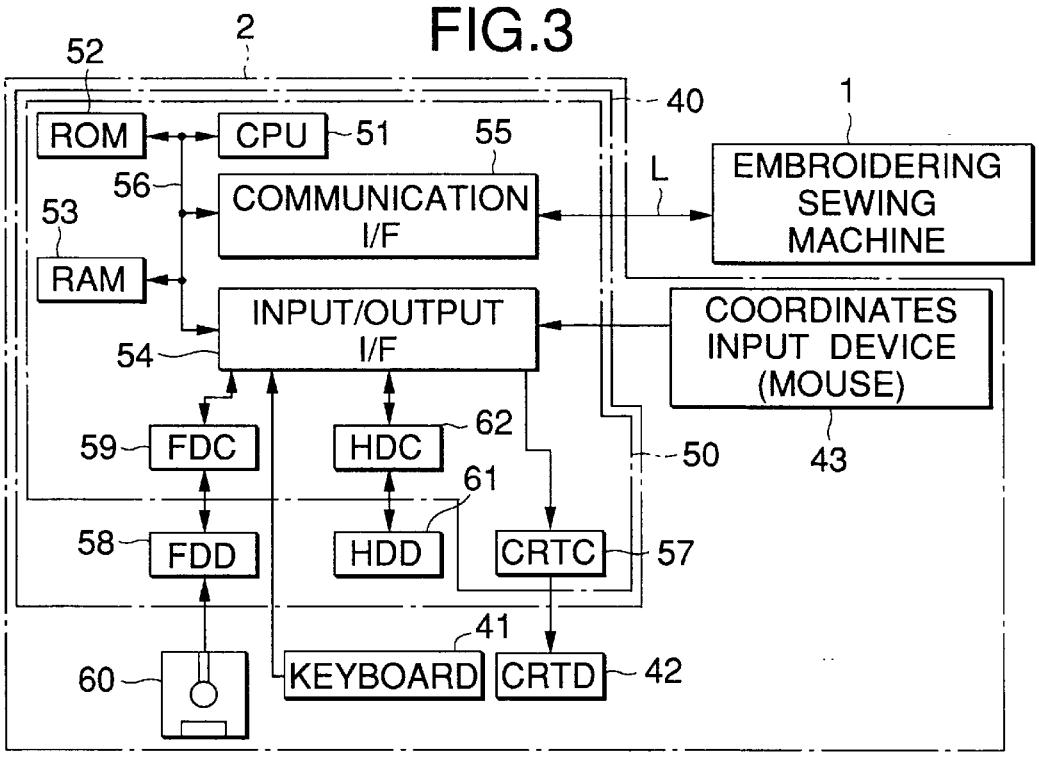

FIG.4

| |
|---|
| VARIOUS SETTING PROCESS PROGRAMS<br>• PATTERN SELECTION PROCESS<br>• SEWABLE AREA SETTING PROCESS<br>• EMBROIDERY FRAME TYPE SETTING PROCESS<br>• EMBROIDERY DATA RETRIEVING PROCESS<br>• EDITTING PROCESS<br>•<br>• |
| DISPLAY CONTROL PROGRAM |
| EMBROIDERING MACHINE DRIVE CONTROL PROGRAMS<br>• INITIALIZING PROGRAM<br>• OPERATING CONDITION FETCHING PROGRAM<br>• STATUS FETCHING PROGRAM<br>• ERROR FETCHING PROGRAM<br>• SEWING DATA TRANSMISSION PROGRAM<br>•<br>• |
| SIMULATION CONTROL PROGRAMS<br>• FIRST VIRTUAL SEWING-MACHINE CONTROL PROGRAM<br>• SECOND VIRTUAL SEWING-MACHINE CONTROL PROGRAM |

[FIRST SEWING-MACHINE CONTROL]

SEWING MACHINE CONTROL SYSTEM

BACKGROUND OF THE INVENTION

1. Field of the Invention

The present invention relates to a control system for a sewing machine. In particular, the present invention relates to a technique by which even in a state where a control system is not connected to an embroidery sewing machine, an operator can experience a setting process for various parametrical items on an embroidering operation and a sewing process with a simulation screen on a display as if the control system is connected to the embroidery sewing machine.

2. Description of Related Art

Various sewing-machine control systems and embroidery sewing machine systems have been proposed and put into practice. Each of those systems is arranged such that a sewing-machine control system made up of a personal computer is connected by wires to an embroidery sewing machine equipped with an embroidering system. The control system sends stitch data (sewing data) for each stitch as well as various control commands to the embroidery sewing machine to control the embroidery sewing machine.

One of those systems is disclosed in Japanese Patent Kokai Publication No. Hei. 5-76670, in which an embroidering process controller is connected to four embroidering devices by way of communication lines. Various parametrical items on the embroidering operation are set in those embroidering devices through the operation of the embroidering process controller. Therefore, sewing data on preselected stitch patterns may be sent to the respective embroidering devices from the embroidering process controller.

When the embroidering process controller is turned ON in a state that four embroidering devices are connected to the embroidering process controller, a display device of the controller displays an initial screen (menu screen) containing the following items: 1. Initial, 2. Quick embroidery, 3. Monogram, and so on. The various parameters on those display items are set in the descending order; 1. Initial, 2. Quick embroidery, . . . . When the item "1. Initial" is executed, a "screen-splitting setting screen" is presented. The number of split screens is set in accordance with the number of embroidering devices to be driven. The embroidering process controller receives device-type data from the related embroidering devices, and displays the device-type data.

When the item "2. Quick embroidery" is executed, embroidery patterns can be chosen, which are to be sewn by the embroidering devices that were set in the item "1. Initial".

In this type of the sewing-machine control system, when no power is supplied to the embroidering devices, it is impossible not only to execute the sewing process but also to set various items on the sewing process, e.g., to set a sewing area.

Incidentally, an information transmission system for a sewing machine is disclosed in Japanese Patent Kokai Publication No. Hei. 7-194880. In this system, a computer is connected to a plurality of embroidering devices, through communication lines. Sewing data and control data are formed using the computer, and sent to the embroidering devices. The computer receives control status signals from the embroidering devices, and statistically or collectively processes those signals to produce information on the production efficiency of each embroidering device and other information necessary for various production managements.

As stated above, the sewing-machine control system using the embroidering process controller connected to four embroidering devices by way of communication lines as disclosed in Japanese Patent Kokai Publication No. Hei. 5-76670, suffers from a problem in that the embroidering process controller is operable for the setting of various parametrical items and the sewing process (see the above setting description on item 1. Initial, 2. Quick embroidery, . . .) only when the controller is connected to the embroidering devices and the power is supplied to the embroidering devices. There is a case where the embroidering process controllers, while being separated from the embroidering devices, are installed in a training room, for example, to train factory workers to learn the skill of operating the sewing-machine control system. In this case, the initial screen is displayed, but the controller rejects the access thereto and disables the setting of most of the parametrical items (menu items) on the initial screen. The controller also rejects the execution of the sewing process. For this reason, the factory workers cannot experience the setting process and the sewing process in association with the items displayed on the screens, e.g., the number of stitches, error messages, and others.

A possible solution to cope with this problem is to connect one embroidering process controller to one embroidery sewing machine. However, this solution is impractical in view of cost and occupying space in a situation where a plurality of embroidering process controllers are used for the training of a number of trainees since the number of embroidery sewing machines equal to that of the embroidering process controllers are required.

SUMMARY OF THE INVENTION

Accordingly, it is an object of the present invention to provide a control system for a sewing machine, which is operable independently from the sewing machine even if the control system is not connected to the sewing machine, and which can simulate a setting process and a sewing process using a display or the like as if the control system is connected to and communicated with the embroidery sewing machine.

To attain the above-noted and other objects, the present invention provides a control system connectable to an embroidery sewing machine. The control system includes display means for indicating a display screen, input means for inputting various parametrical values and commands, and control means for controlling the display means and the sewing machine in accordance with parametrical values input by the input means and a plurality of sewing machine control programs. The control system further includes simulation control means for supplying various kinds of pseudo-signals, in place of signals to be supplied from said sewing machine, to said control means when a predetermined condition is met. With the simulation control means, the control means can be operated as if the control system is connected to the sewing machine. The control system preferably includes judging means for judging whether or not the sewing machine is connected to the control system. The control system is particularly applicable to the embroidery sewing machine.

The control system in use with the embroidery sewing machine includes the display means, the input means and the control means. When the judging means judges that the embroidery sewing machine is connected to the control system, embroidery patterns to be sewn are set, the frame number of the embroidering frame is set, and a sewing area for embroidering is set by use of the input means and the display means. The values of those setting items and commands are input to the control system. The information of those set items are visually presented by the display means. The embroidery sewing machine is driven to sew in accordance with the set information and a plurality of control programs.

When the judging means judges that the embroidery sewing machine is not connected to the control means, the simulation control means, in place of the embroidery sewing machine, outputs various kinds of pseudo-signals to the control means to operate the input means and the display means. The pseudo-signals correspond to signals to be produced by and supplied from the embroidery sewing machine. Examples of the pseudo signals are a sewing-area-information reception acknowledge signal indicating reception of a sewing-area information, a number-of-stitches count signal indicative of a count of the number of stitches. Therefore, the control means can be operated as if it is connected to the embroidery sewing machine, so that the items on the initial screen can be set, and the sewing job can also be executed as if an actual sewing operation is performed.

Therefore, only the control system can be installed in a training room and can be used for training employees in a virtual environment.

The simulation control means outputs to the control means a pseudo sewing-area-information reception acknowledge signal indicating reception of sewing-area information.

When a sewing area for an embroidering frame to be used is set, the simulation control means operates the control system as if the sewing area information is actually received by the embroidery sewing machine. That is, the simulation control means outputs a pseudo sewing-area-information reception acknowledge signal to the control means. Therefore, the sewing area can be set as if the control system is actually connected to the embroidery sewing machine.

The simulation control means outputs to the control means a pseudo number-of-stitches count signal corresponding to a signal indicative of a count of the number of stitches.

When a sewing start command is issued, an actual sewing job is not carried out but the pseudo number-of-stitches count signal is supplied to the control means in place of an actual number-of-stitches count signal, so that the sewing process can be simulated as if the embroidery sewing machine is actually operated.

The simulation control means outputs a pseudo error signal indicative of occurrence of an error to the control means.

When the frame number of the embroidering frame is set, a sewing area to be used for embroidering is set, or a pseudo sewing state is set up, the simulation control means outputs a pseudo error signal indicative of occurrence of an error to the control means, so that errors in the setting operation or the sewing status are displayed. Therefore, a virtual sewing status as if the embroidery sewing machine is actually operating is presented.

The simulation control means outputs to the control means a pseudo rotation signal corresponding to a rotation signal indicative of a rotation of the main shaft of the embroidery sewing machine.

When a virtual sewing status is set up, the simulation control means outputs a pseudo rotation signal to the control means, so that a rotation speed of the machine is displayed. Therefore, the virtual sewing status is rendered to more closely resemble the actual sewing status.

The present invention further provides a storage medium. The storage medium stores therein a main-control program for setting parametrical items using display and input devices, sending the parametrical items to a sewing machine, and controlling the sewing machine based on the parametrical items. The storage medium stores therein a sub-control program with which the main control program is partially replaced when a predetermined condition is met. The sub-control program serves to virtually produce a reception acknowledge signal that is required to continue execution of the main control program and that is to be produced if said parametrical items are received by and set for said sewing machine, and display and vary pseudo information on the display device as if the sewing machine is controlled based on the parametrical items in accordance with the main control program. With the storage medium, the main-control program as well as the sub-control program can be readily installed in a personal computer or the like, so that the personal computer can be expanded to have the simulation function. The personal computer or the like in which the main-control program and the sub-control program are installed is useful regardless of whether or not it is connected to the sewing machine.

The present disclosure relates to the subject matter contained in Japanese patent application No. Hei. 9-309716 (filed on Oct. 24, 1997) which is expressly incorporated herein by reference in its entirety.

BRIEF DESCRIPTION OF THE DRAWINGS

FIG. 3 is a block diagram showing a control system contained in the machine control system.

FIG. 4 is a diagram showing a structure of control programs stored in a hard disk.

DETAILED DESCRIPTION OF THE PREFERRED EMBODIMENT

The preferred embodiment of the present invention will be described with reference to the accompanying drawings.

Figure 1:
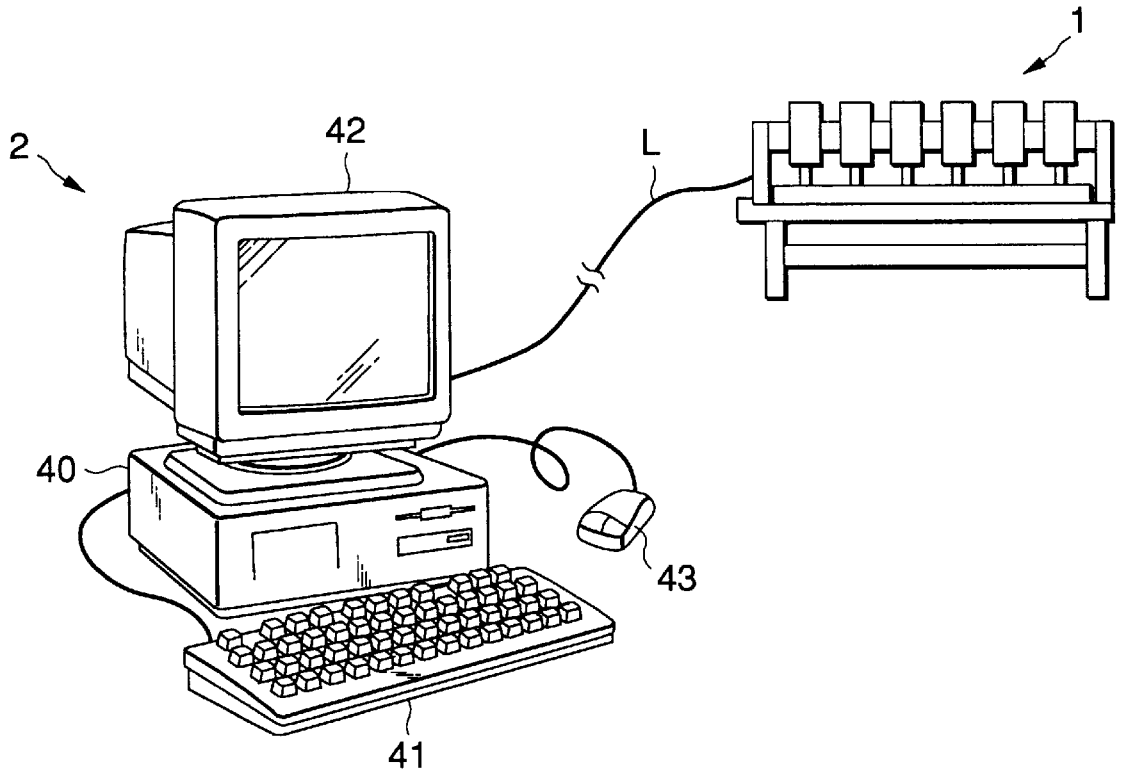
FIG. 1 is a perspective view showing an embroidering sewing machine and a machine control system, which are constructed according to the present invention.

In the embodiment to be discussed hereunder, the present invention is applied to an embroidery sewing machine control device 2 made up of a personal computer, which is connected to a single embroidering sewing machine 1 by way of a dedicated connection line L as shown in FIG. 1.

The embroidering sewing machine 1 has six sewing machine units M1 to M6 arranged side by side. Six embroidering frames 35 (see FIG. 10) are attached to a large movable frame (not shown). Materials to be sewn are respectively held on those embroidering frames 35 so that the same embroidery patterns are sewn onto those materials simultaneously.

A control system of the embroidering sewing machine 1 will first be described.

Figure 2:
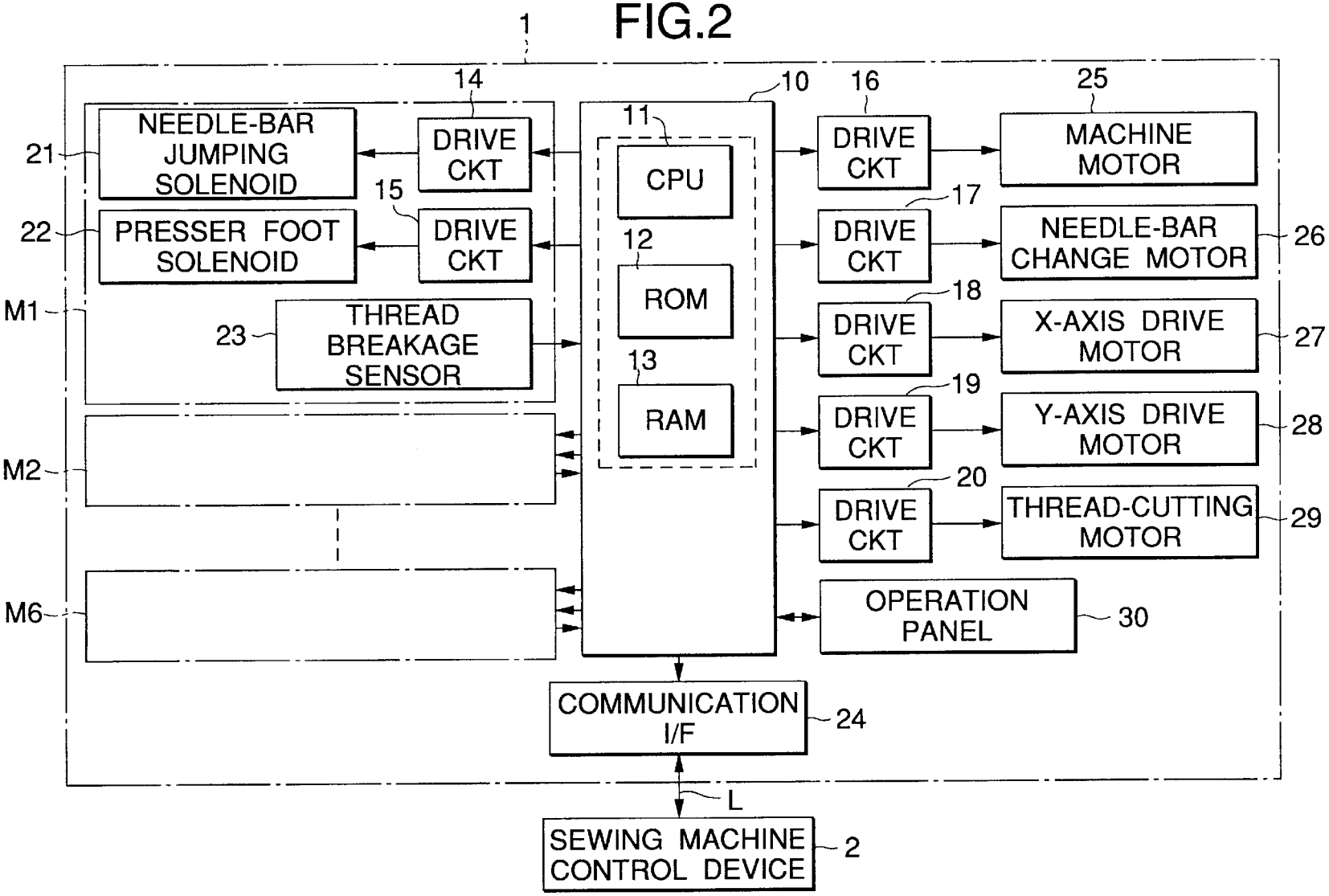
FIG. 2 is a block diagram showing a control system of the embroidery machine.
Figure 5:
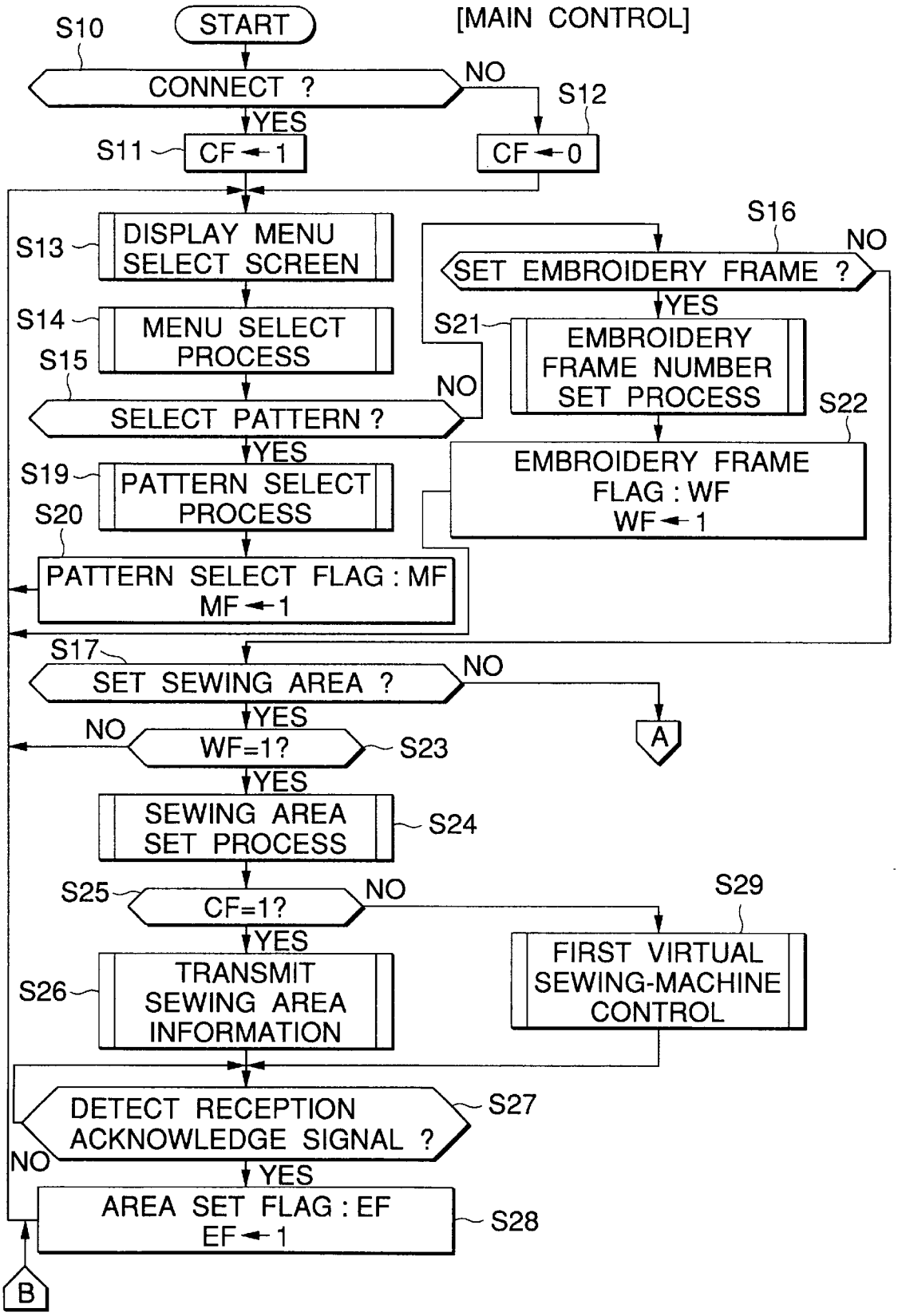
FIG. 5 is a flow chart showing a first part of a main control routine.
Figure 6:
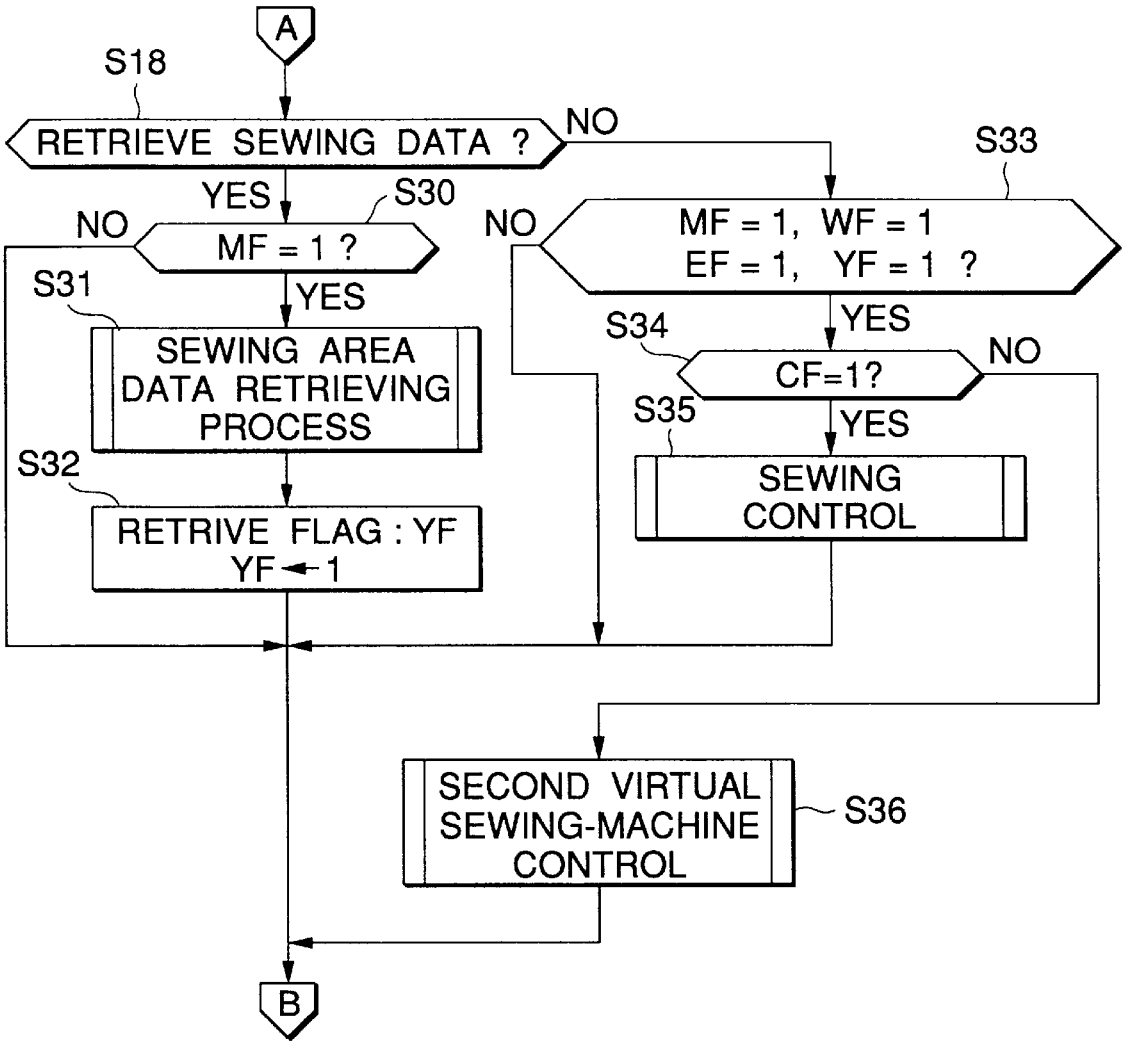
FIG. 6 is a flow chart showing a second part of the main control routine.
Figure 7:
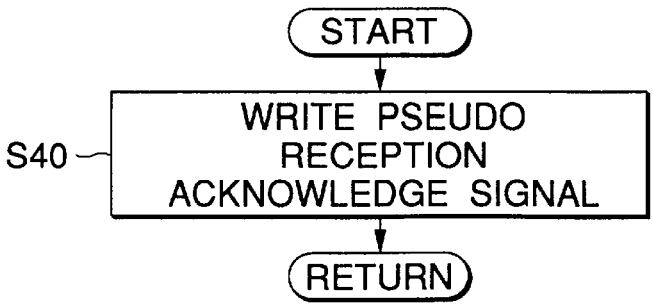
FIG. 7 is a flow chart showing a subroutine of a first virtual machine control.
Figure 8:
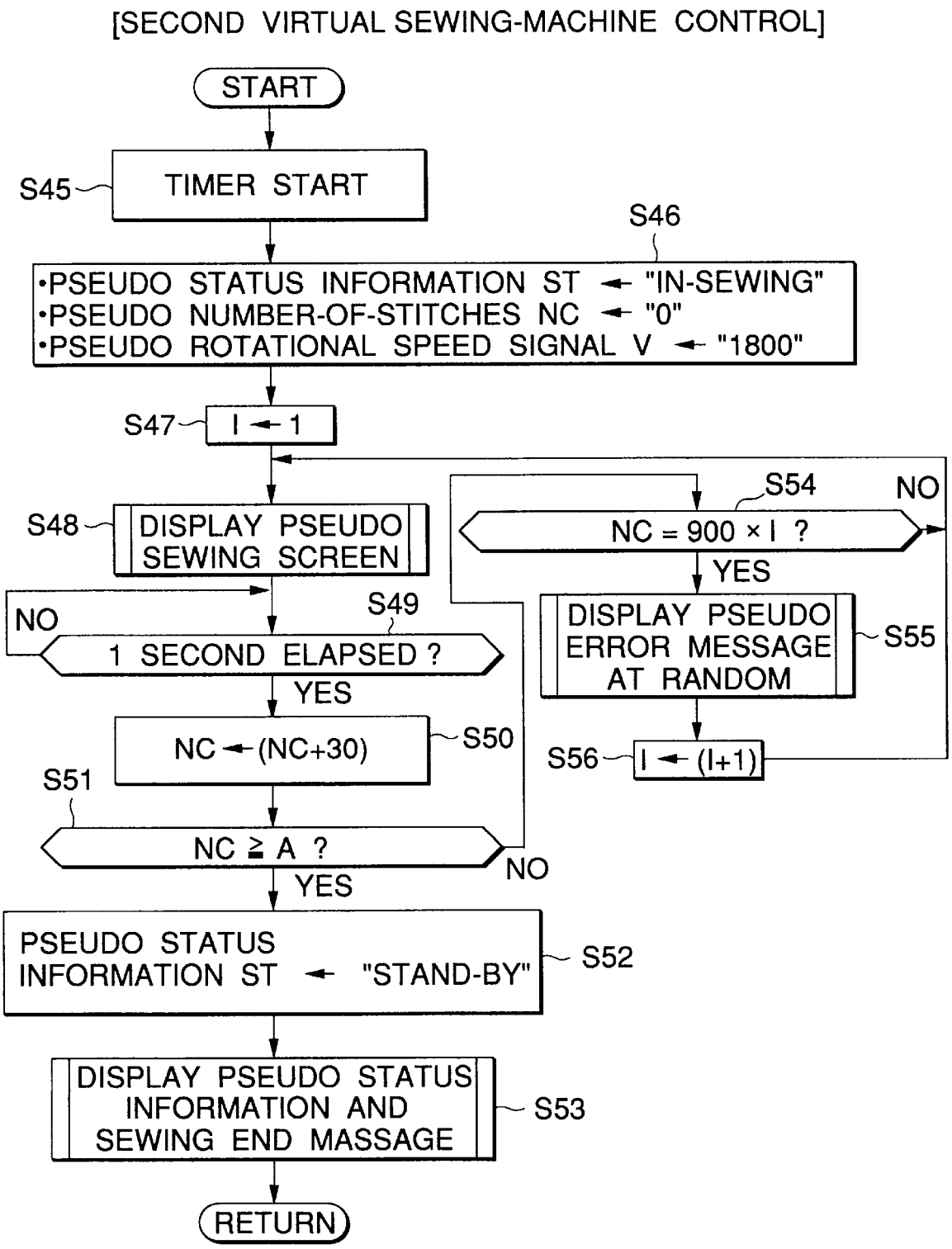
FIG. 8 is a flow chart showing a subroutine of a second virtual machine control.

Referring to FIG. 2, there is shown in block form the control system of the embroidery machine 1. A control unit or host controller 10 controls an overall operation of the embroidering sewing machine 1. The control unit 10 is generally made up of a microcomputer including a CPU 11, a ROM 12 and a RAM 13, and input/output interfaces (not shown) connected to the microcomputer through data buses or the like. A plurality of drive circuits 14 to 20 are connected to the control unit 10.

The first sewing machine unit M1 of the embroidering sewing machine 1 includes a needle-bar jumping solenoid 21 for driving a needle-bar jumping mechanism to forcibly jump a needle bar to its upper position, a presser foot solenoid 22, and a thread-breakage sensor 23 for sensing a breakage of a needle thread. Those solenoids 21 and 22 and the thread-breakage sensor 23 are connected to the control unit 10. The remaining sewing machine units, or the second to sixth sewing machine units M2 to M6, are constructed in a similar fashion. The control unit 10 includes a communication interface (I/F) 24, e.g., a Centronics interface, and may transmit data to and receive the same from the personal computer or sewing-machine control device 2 through the communication I/F 24.

The control unit 10 is further connected to the drive circuits 16, 17, 18, 19 and 20, and an operation panel 30. The drive circuit 16 is provided for a sewing-machine motor 25. The drive circuit 17 is for a needle-bar change motor 26 for simultaneously moving needle-bar cases which are respectively provided in the sewing machine units M1 to M6 and support needle bars vertically movably. The drive circuit 18 is for an X-axis drive motor 27 for moving the movable frame in the X-axis (right-and-left) directions. The drive circuit 19 is for an Y-axis drive motor 28 for moving the movable frame in the Y-axis (back-and-forth) directions. The drive circuit 20 is for a thread-cutting motor 29 which swingably moves a movable blade with respect to a fixed blade to cut both the needle and bobbin threads. The operation panel 30 contains a power switch, various operation switches, indication lamps, and others.

The ROM 12 stores control programs, for example, a data transmission/reception control program, and a sewing-operation control program. According to the data transmission/reception control program, the control unit 10 receives sewing data and control commands from the sewing-machine control device 2, and transmits to the sewing-machine control device 2 various control signals, which correspond to control commands, e.g., a sewing-area-information reception acknowledge signal and a number-of-stitches count signal, and an error signal when an error occurs. According to the sewing-operation control program, the embroidering sewing machine 1 is driven by the motors 25 to 29 to execute a sewing process.

A control system of the personal computer or sewing-machine control device 2 will be described.

Reference is made to FIG. 3. There is shown in block form the control system of the sewing-machine control device 2. As shown, the personal computer 2 is generally made up of a control box 40, a keyboard 41, a color CRT display device 42, a coordinates input device (mouse) 43. The control box 40 includes a floppy disk drive 58 to which a floppy disk 60 may be loaded, a hard disk drive 61 equipped with a hard disk, and the like. The keyboard 41 and the mouse 43 form "input means".

A host controller 50 contained in the control box 40 includes a CPU 51, a ROM 52 and a RAM 53 connected to the CPU 51 through a common bus 56, e.g., a data bus, an input/put interface (I/F) 54, a communication interface (I/F) 55, a CRT controller (CRTC) 57 for outputting display data to the color CRT display device (CRTD) 42, a floppy disk controller (FDC) 59 for driving/controlling the floppy disk drive (FDD) 58, and a hard disk controller (HDC) 62 for driving/controlling the hard disk drive 61. The CRTC 57, FDC 59 and HDC 62 are connected to the input/output I/F 54.

The communication interface (I/F) 55 is similar to the communication I/F 24 of the embroidering sewing machine 1, and is connected to the embroidering sewing machine 1 by way of the connection line L.

The input/output I/F 54 is coupled to the keyboard 41 for entering characters, symbols and various commands, and the coordinates input device (mouse) 43.

The ROM 52 stores an initial program for booting the sewing-machine control device 2 at the time of power-on as in the general personal computer.

A hard disk fixedly mounted on the HDD 61 stores operating systems, e.g., MS-DOS and windows system, a communication protocol for transmitting and receiving data and control signals to and from the embroidering sewing machine 1, application programs that may be executed under the operating system, e.g., word processing program and sewing data preparing program, and various sewing-machine control programs.

FIG. 4 shows an example of the sewing-machine control programs stored in the hard disk. As shown, the sewing-machine control programs include various setting process programs, a display control program, and embroidering-machine drive control programs. Simulation control programs according to the present invention are additionally stored in the hard disk.

The setting process programs include control programs for a pattern selection process, a sewable area setting process, an embroidery frame type setting process, an embroidering data retrieving process, an editing process, etc.

The embroidering-machine control programs include control programs, such as initializing programs for initializing the host controller 50 and the embroidering sewing machine 1, respectively, a program for fetching operating conditions of the embroidering sewing machine 1, a program for fetching a status of the embroidering sewing machine 1, a program for fetching an error occurring in the embroidering sewing machine 1, and a transmitting program for transmitting sewing data to the embroidering sewing machine 1. The simulation control programs include a first virtual sewing-machine control program and a second virtual sewing-machine control program.

The floppy disk 60, which is removably loaded to the FDD 58, stores therein a large number of pattern data indicative of embroidery patterns (including sewing data, color changing data, and others) in a state that those embroidery patterns are categorized into a plurality of groups according to the types of the embroidery patterns. The sewing data are in the form of stitch data indicative of stitch positions in the X- and Y-coordinates and used to sew regions of different colors of the embroidery patterns.

The RAM 53 includes a data memory for temporarily storing various data, a work memory, and memories for various flags, pointers, counters, and others.

A main routine according to the control programs including the simulation control programs of the present invention, which are stored in the hard disk, will be described along flow charts with reference to FIGS. 5 to 8. In the flow charts, a character Si (i=10, 11, 12, . . .) indicates a step number. Description will be given on the assumption that a power has been supplied to the embroidering sewing machine 1.

Upon power-on of the embroidering sewing machine 1, execution of the main routine starts, various initializing settings are executed, and the CPU 51 (of the host controller 50) checks if the sewing-machine control device 2, or the host controller 50, is connected to the embroidering sewing machine 1 (S10).

The connection line L includes a plurality of signal lines for transmitting data in parallel, and a connection-detecting signal line, a signal level of which goes low (L) in logic level only when the host controller 50 is connected to the embroidering sewing machine 1. A logic level of the connection-detecting signal is used for determining whether or not the connection is made. If the connection is made (S10; YES), a connection flag CF is set (flag data is rendered "1" in logic state) (S11). If no connection is made (S10; NO), the connection flag CF is reset (flag data is rendered "0") (S12). A menu select screen containing a plurality of items for selection is displayed by the CRTD (display device) 42 (S13).

Figure 9:
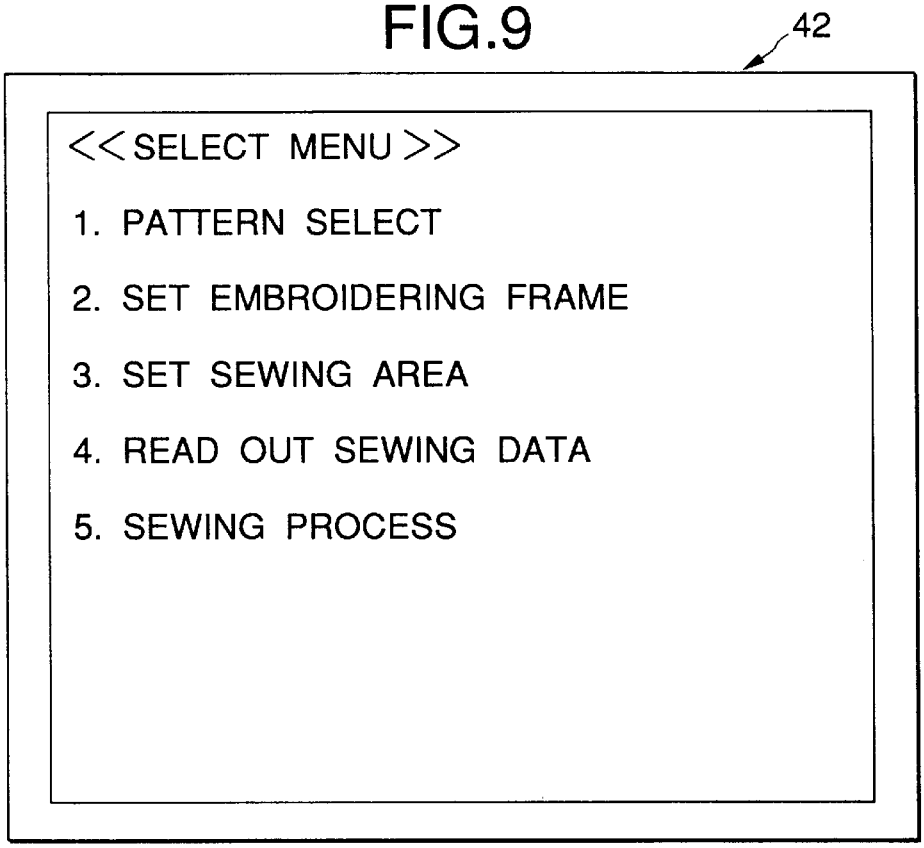
FIG. 9 is a diagram showing a menu select screen.

An example of the menu select screen is shown in FIG. 9. As shown, the menu select screen contains a list of items; 1. Pattern select, 2. Set embroidering frame, 3. Set sewing area, 4. Read out sewing data, and 5. Sewing process.

A menu select process in step S14 is executed to select a desired item on the menu select screen, by entering its item number by depressing a related key on the keyboard 41. When the item of "1. Pattern select" is selected (S15; YES), a pattern select process in step S19 is executed to select one of the embroidery patterns displayed on the screen of the CRT display device (CRTD) 42, irrespective of its connection to the embroidering sewing machine 1.

In the pattern select process, a plurality of embroidery patterns are displayed group by group sequentially. The operator, while viewing the pattern screen, operates the mouse 43 to point to his or her desired pattern with an arrow-head marker 43*a* on the screen. Upon the pattern selection, the CPU 51 sets a pattern select flag MF (S20), and returns to the step S13.

When the selected item is "2. Set embroidering frame" (S16; YES), a frame-number setting process in step S21 is executed to select the frame number of the embroidering frame 35 most suitable for the embroidering operation irrespective of its connection to the embroidering sewing machine 1. A list of the numbers of the embroidering frames 35 different in size and configuration for holding tubular materials and flat materials is displayed on the screen of the CRTD 42. Then, the operator points to his or her desired frame number on the screen with the arrow-head marker 43*a* as in the case of the pattern selection.

The CPU 51 sets a frame setting flag WF(S22), and returns to the step S13.

Figure 10:
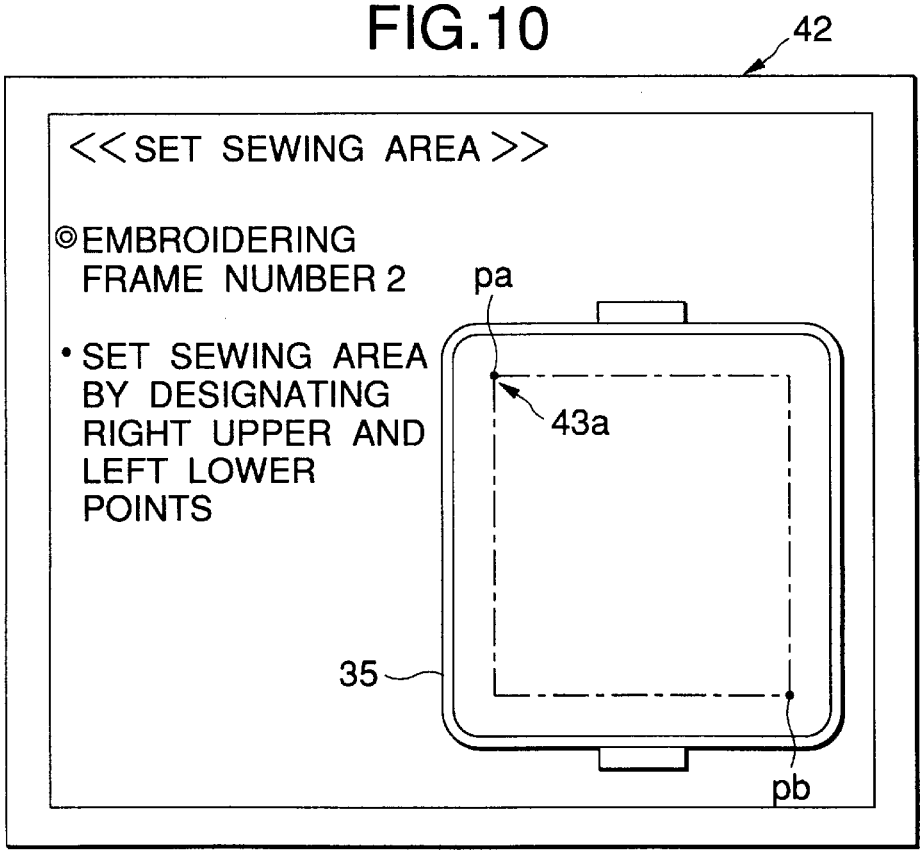
FIG. 10 is a diagram showing a sewing-area setting screen.

When the selected item is "3. Set sewing area" (S17; YES), if the embroidering frame 35 is selected and therefore the frame setting flag WF is set (S23; YES), a sewing area setting process in step S24 is executed to set an actually sewable rectangular region within the selected frame 35. In this process, a sewing area setting screen containing the selected embroidering frame 35 is displayed as shown in FIG. 10. The operator designates the sewing area enclosed by a one-dot chain line by pointing to the left upper position pa and the right lower position pb with the cursor, according to the instruction located on the left side on the screen.

If the sewing area setting operation is erroneous, an error message, for example, may be displayed on the screen.

At this time, if the connection flag CF is set (S25; YES), sewing information containing the frame number, sewing area, and the like is transmitted to the embroidering sewing machine 1 (S26), and the execution in step S27 continues till an sewing-area-information reception acknowledge signal representative of the acknowledgement of reception of the sewing information from the embroidering sewing machine 1 is detected. At this time, upon reception of the sewing information containing the frame number, sewing area and the like, and upon completion of its setting, the embroidering sewing machine 1 sends the sewing-area-information reception acknowledge signal to the sewing-machine control device 2.

As a result, in the sewing-machine control device 2, or the personal computer, the received sewing-area-information reception acknowledge signal is stored into the work memory of the RAM 53; the sewing-area-information reception acknowledge signal is detected upon the signal storing (S27; YES); and the CPU 51 sets an area setting flag EF (S28); and returns to the step S13.

When the connection flag CF is not set (S25; NO), the first virtual sewing-machine control subroutine (FIG. 7) of the simulation control is executed (S29).

Upon start of the subroutine, the program considers that the sewing information containing the frame number, sewing area and the like have been received and set, and forms a pseudo sewing-area-information reception acknowledge signal, and stores the signal into the work memory of the RAM 53 (S40). The CPU 51 completes the execution of the subroutine, and returns to the main routine of the control. As a result, the sewing-area-information reception acknowledge signal is detected and the area setting flag EF is set (S27, S28) as if the sewing-machine control device 2 is actually connected to the embroidering sewing machine 1.

When the selected item is "4. Read out sewing data" (S18; YES, FIG. 6), if the pattern select flag MF is set, and an embroidery pattern to be sewn is selected (S30; YES), the CPU 51 (of the host controller 50), irrespective of its connection to the embroidering sewing machine 1, reads out the sewing data of that pattern from the floppy disk 60, stores the sewing data into a predetermined memory in the RAM 53 (S31), sets a readout flag YF (S32) and then returns to the step S13.

A case where the selected item is "5. Sewing process" (S18; NO) will be described. In this case, if the pattern select flag MF, frame setting flag WF, area setting flag EF and the readout flag YF are all set so that the sewing process is executable (S33; YES), and if the connection flag CF is set (S34; YES), the CPU 51 executes the sewing control, e.g., sending of the sewing data to the embroidering sewing machine 1 (S35), and returns to the step S13.

If the connection flag CF is reset and the host controller 50 is not connected to the embroidering sewing machine 1 (S34; NO), the second virtual sewing-machine control program of the simulation control (FIG. 8) is executed (S36).

When the subroutine of the second virtual sewing-machine control program starts, the contents of a timer T (not shown) contained in the host controller 50 is cleared, the timer T starts the counting of time (S45), and the following pseudo items are set (S46): "in-sewing" data is set for a pseudo status information ST as a pseudo expression of a status (operating state) of the embroidering sewing machine 1; the initial value is set to "0" for a pseudo number-of-stitches NC as a pseudo expression of the number of sewed stitches; and "1800" is set for a pseudo rotation speed signal V as a pseudo rotation speed of the main shaft of the embroidering sewing machine 1.

Figure 11:
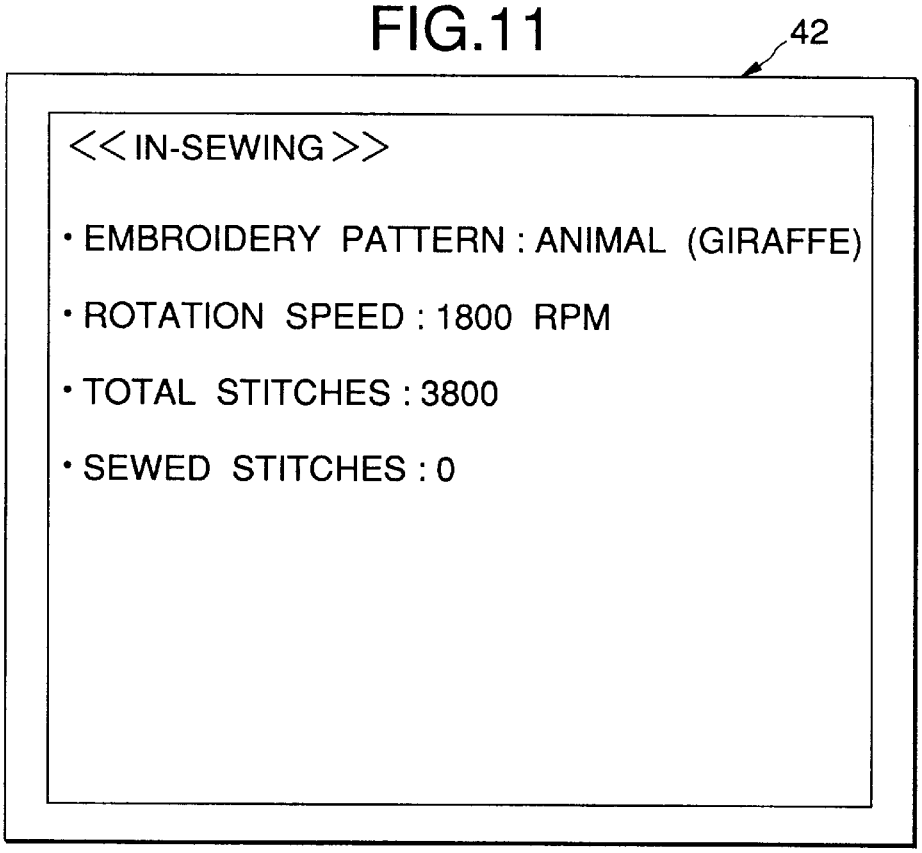
FIG. 11 is a diagram showing a sewing information screen displayed immediately after the sewing operation starts.

Then, the CPU 51 sets "1" as the counter value I of the counter for generating a pseudo error signal during the sewing operation (S47). A pseudo sewing screen is displayed by the CRTD 42 (S48). The pseudo sewing screen is constructed with the pseudo status information ST, the pseudo number-of-stitches NC and the pseudo rotation speed signal V in association with their contents and values, those being already set. An example of the pseudo sewing screen is shown in FIG. 11. As shown, the status information is "in-sewing"; the embroidery pattern is "animal (giraffe); the rotation speed is "1800 rpm"; the total number of stitches is "3800"; and the number of sewed stitches is "0".

When the timer T indicates "1" second (elapse of 1 second) (S49; YES), the pseudo number-of-stitches NC is incremented by "30" (S50). When the pseudo number-of-stitches NC is smaller than the total number of stitches A (S51; NO) and NC is not equal to (900×I) (S54; NO), the CPU 51 repeats the execution of the sequence of steps S48 to S54. When 30 seconds, for example, elapsed from the start of the sewing operation, the number of sewed stitches is increased to "900" on the pseudo sewing screen (FIG. 11). In this way, the display is presented on the screen as if the embroidering sewing machine 1 is actually operating.

Figure 12:
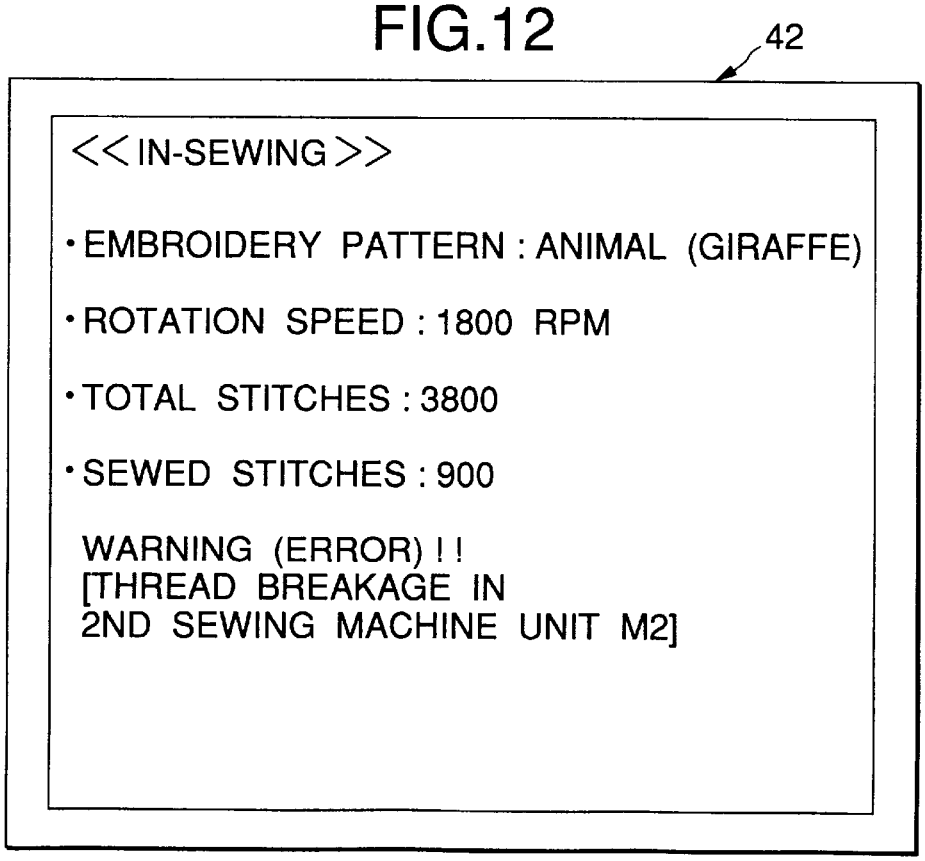
FIG. 12 is a diagram showing the sewing information screen displayed after the sewing operation starts.

When the pseudo number-of-stitches NC is equal to the number of stitches set using the counter value I (NC=900×I, S54; YES), one error message is randomly selected from error messages previously provided and is displayed as a pseudo error message (S55); the counter value I is incremented by "1"; and the program returns to the step S48. Examples of those error messages are "thread breakage in 2nd sewing machine unit", "thread breakage in 4th sewing machine unit", "emergency stop", . . . . An example of the pseudo sewing screen when NC is equal to (900×I) is shown in FIG. 12. In this example, the error message randomly selected is "thread breakage in 2nd sewing machine unit M2" as shown.

Figure 13:
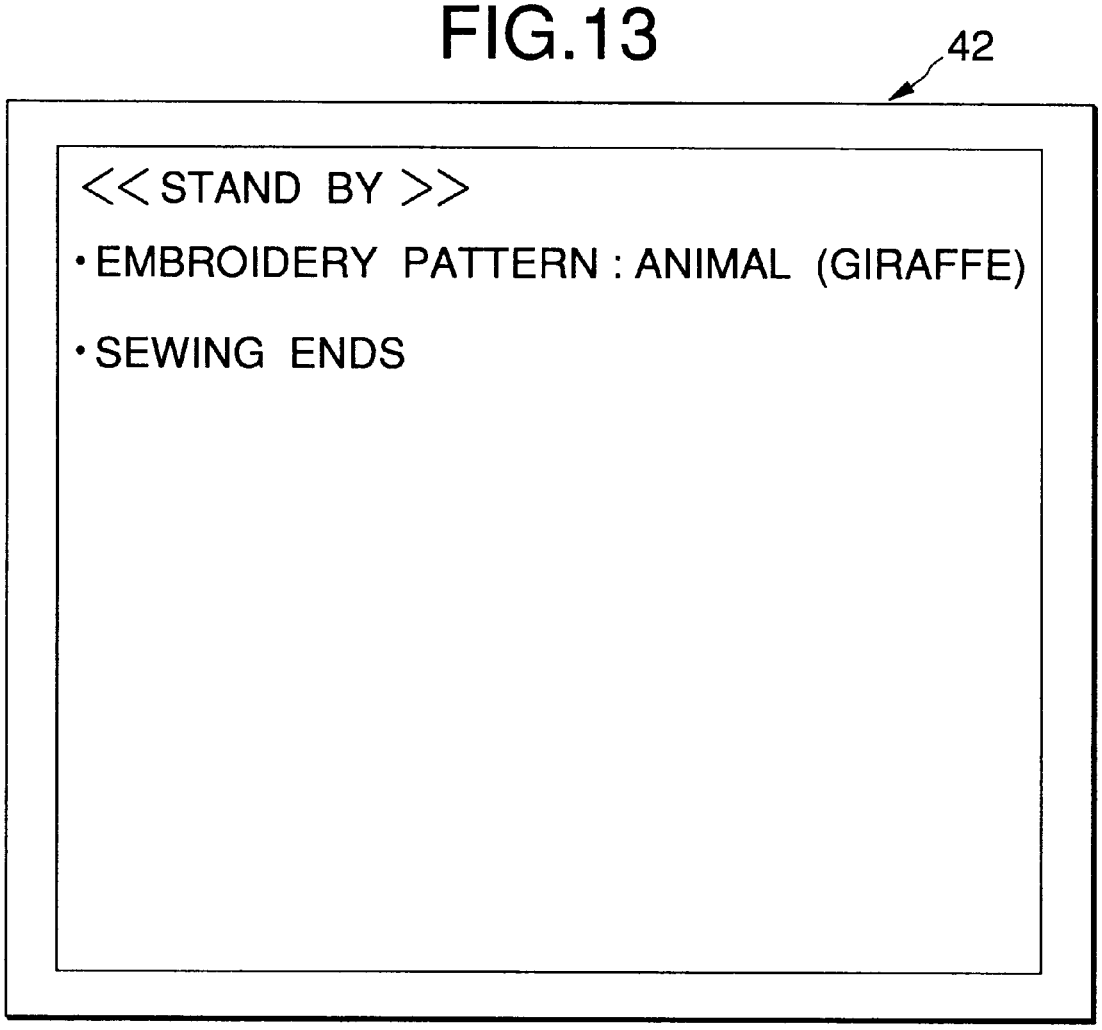
FIG. 13 is a diagram showing the sewing information screen displayed when the sewing operation ends.

When NC is equal to or greater than A (total number of stitches) (S51; YES), "stand-by" data is set for the pseudo status information ST (S52); the pseudo status information "stand-by" and a "sewing ends" message are displayed by the CRTD 42 (S53); and the CPU 51 completes the control of this subroutine, and returns to the step S13 in the main routine. At this time, "stand-by" (status information) and "sewing ends" (message) are displayed on the screen of the CRTD 42 as shown in FIG. 13.

In the embodiment described above, the steps S10 to S12 in the main routine (FIG. 5) form judging means to judge if the host controller 50 is connected to the embroidering sewing machine 1. The simulation control routine containing the first and second virtual sewing-machine control programs, which is stored in the hard disk, mainly form simulation control means. The display control program, CRTD 42, the CRTC 57 and the like form display means.

The main control, particularly the simulation control, to be executed by the sewing-machine control device 2 will be described on its operation and useful effects.

When the sewing-machine control device 2 starts its control, it detects its connection to the embroidering sewing machine 1, and the connection flag CF is set. When the sewing-machine control device 2 is not connected to the embroidering sewing machine 1, the connection flag CF is reset. The menu select screen is displayed by the CRTD 42. A desired item is selected from a list of items on the screen. When the setting process is executed with respect to the selected item, various kinds of pseudo signals in place of the actual signals produced from the embroidering sewing machine 1 are produced and supplied to the host controller 50, as if the sewing-machine control device 2 is connected to the embroidering sewing machine 1.

For example, when the selected item is "2. Set embroidering frame", the sewing-area setting process is executable regardless of whether or not the sewing-machine control device 2 is connected to the embroidering sewing machine 1. When the embroidering sewing machine 1 is not connected to the sewing-machine control device 2, the sewing-machine control device 2, more exactly the CPU 51 of the host controller 50 thereof executes the first virtual sewing-machine control program; receives the set sewing information including the frame number, sewing area information and the like; forms a pseudo sewing-area-information reception acknowledge signal and stores it into the work memory of the RAM 53; and hence detects the sewing area-information reception acknowledge signal as if the control device is connected to the embroidering sewing machine 1.

When the selected item is "5. Sewing process", the sewing-machine control device 2 operates in the following manner. In a state where the sewing-machine control device 2 is not connected to the embroidering sewing machine 1, the second virtual sewing-machine control program is executed. The following parametrical items are set: "in-sewing" data is set for the pseudo status information ST as a pseudo expression of a status (operating state) of the embroidering sewing machine 1; the initial value is set to "0" for a pseudo number-of-stitches NC as a pseudo expression of the number of sewed stitches; and "1800" is set for a pseudo rotation speed signal V as a pseudo rotation speed of the main shaft of the embroidering sewing machine 1. A pseudo sewing screen is displayed by the CRTD 42. The pseudo sewing screen is constructed with the pseudo status information ST, the pseudo number-of-stitches NC and the pseudo rotation speed signal V in association with their contents and values, those being previously set. The value of the number of stitches is incremented by "30" every time one (1) second elapses. Therefore, the display on the screen is presented as if the embroidering sewing machine 1 is actually operating.

Every time NC (pseudo number-of-stitches) becomes equal to (900×I), one error message, for example, "thread breakage in 2nd sewing machine unit", is randomly selected from error messages previously provided and is displayed as a pseudo error message. Therefore, the CRTD 42 presents a display on the screen as if the embroidering sewing machine 1 is actually operating.

Further, since the pseudo rotation speed signal V is displayed as a pseudo rotation speed of the main shaft of the embroidering sewing machine 1, the virtual sewing operation is more real.

The contents of the simulation control program may be modified or altered so as to make the virtual sewing operation of the embroidering sewing machine 1 more realistic. A first example of the program modification is to display the machine number of the sewing machine without a material being sewn and out of operation, by producing a pseudo signal indicative of that machine number. A second example of the program modification is to permit an operator to set the pseudo rotation speed to an arbitrary speed, and to display a pseudo rotation speed based on the speed set. Thus, it should be understood that the simulation control program described and illustrated is merely illustrative, and may be modified, altered, and changed within the scope and spirit of the present invention.

Further, the control system for the sewing machine can be modified in various manners. For example, a selection switch may be provided on the connection line L between the communication interface 55 of the sewing-machine control device 2 and the communication interface 24 of the sewing machine 1 so that an operator can select whether the sewing-machine control device 2 is connected to the sewing machine 1. In this case, the status as to whether or not the sewing-machine control device 2 is connected to the sewing-machine 1 is judged depending on whether the selection switch is ON or OFF. Moreover, a program, which permits an operator to select one of a simulation mode and a normal mode, may be installed in the hard disk provided in the HDD 61 so that the CPU 51 can execute the first and second virtual sewing-machine control programs even if the sewing machine control device 2 is connected to the sewing machine 1. In this modification, when the normal mode is selected by the operator, the CPU executes the main control routine described with reference to FIGS. 5 to 8 and indicates, if the sewing machine control device 2 is not connected to the sewing machine 1, an error massage (such as "No Connection") on the display 42 in place of the execution of each of the first and second virtual sewing-machine control programs. On the other hand, when the simulation mode is selected by the operator, the connection flag CF is forcibly set as "0" in the step S11 so that the CPU 51 can enter into the subroutines of the first and second virtual sewing-machine control programs regardless of whether the sewing machine control device 2 is connected to the sewing machine 1.

In the embodiment under discussion, the simulation program and the main control program are stored in the hard disk fixedly mounted to the HDD 61. The simulation program may be separated from the main program and stored in a storage medium, such as a floppy disk and a CD-ROM, other than the hard disk. A floppy disk storing the simulation program can be mounted to the FDD 58, and alternatively a CD-ROM storing the simulation program may be mounted to a CD-ROM drive, if the simulation function is required to be added.

It should be understood that the sewing machine control system and so on described in connection with the embodiment are examples, and hence those may be modified, altered and changed without departing from the spirit of the present invention.

What is claimed is:

1. A control system connectable to a sewing machine, said control system comprising:

display means for indicating a display screen;

input means for inputting various parametrical values and commands;

control means for controlling said display means and said sewing machine in accordance with parametrical values input by said input means and a plurality of sewing machine control programs; and simulation control means for supplying various kinds of pseudo-signals, in place of signals to be supplied from said sewing machine, to said control means when a predetermined condition is met, thereby operating said control means as if said control system is connected to said sewing machine.

2. A control system according to claim 1, further comprising:

judging means for judging whether or not said control system is connected to said sewing machine.

3. A control system according to claim 1, wherein said simulation control means supplies to said control means a pseudo sewing-area-information reception acknowledge signal in place of a signal that is to be supplied from said sewing machine and that indicates said sewing machine receives sewing-area information from said control means.

4. A control system according to claim 1, wherein said simulation control means supplies to said control means a pseudo number-of-stitches count signal in place of a signal that is to be supplied from said sewing machine and that is indicative of a counted number of stitches.

5. A control system according to claim 1, wherein said simulation control means supplies to said control means a pseudo error signal indicative of virtual occurrence of an error.

6. A control system according to claim 1, wherein said simulation control means supplies to said control means a pseudo rotation signal in place of a signal that is to be supplied from said sewing machine and that is indicative of a rotation of a main shaft of said sewing machine.

7. A control system according to claim 1, wherein said predetermined condition is a state in which said control system is not connected to said sewing machine.

8. A control method of controlling a sewing machine with a control system having display means for indicating a display screen, input means for inputting various parametrical values and commands, and control means for controlling said display means and said sewing machine in accordance with parametrical values input by said input means and a plurality of machine control programs, said control method comprising the steps of:

supplying a plurality of pseudo-signals, in place of signals to be supplied from said sewing machine, to said control means when a predetermined condition is met; and operating said control means using said pseudo-signals as if said control means is connected to said sewing machine.

9. A control method according to claim 8, wherein said control means judges whether or not said control means is connected to said sewing machine.

10. A method of simulating setting and sewing operations for a sewing machine using a control system connectable to said sewing machine, said method comprising the steps of:

setting parametrical items to be used for controlling said sewing machine while indicating said parametrical items on a display in accordance with a main control program designed to actually control said sewing machine;

virtually producing a reception acknowledge signal in accordance with a first virtual control program, said reception acknowledge signal being required to continue execution of said main control program, and being produced if said parametrical items are received by and set for said sewing machine; and displaying and varying pseudo information on said display in accordance with a second virtual control program as if said sewing machine is controlled based on said parametrical items in accordance with said main control program.

11. A method of simulating according to claim 10, further comprising the step of:

detecting whether or not said control system is connected to said sewing machine.

12. A method of simulating according to claim 10, wherein said virtual producing step includes producing a pseudo sewing-area-information reception acknowledge signal as said reception acknowledge signal.

13. A method of simulating according to claim 10, wherein said displaying and varying step includes indicating a pseudo number of stitches virtually counted.

14. A method of simulating according to claim 10, wherein said displaying and varying step includes indicating a pseudo error message on said display.

15. A method of simulating according to claim 10, wherein said displaying and varying step includes indicating a pseudo sewing speed of said sewing machine.

16. A control system connectable to a sewing machine, said system comprising:

a display device;

an input device;

a storage device, which stores therein:

a main-control program for setting parametrical items using said display and input devices, sending said parametrical items to said sewing machine, and controlling said sewing machine based on said parametrical items; and a sub-control program with which said main control program is partially replaced when a predetermined condition is met, said sub-control program serving to virtually produce a reception acknowledge signal that is required to continue execution of said main control program and that is to be produced if said parametrical items are received by and set for said sewing machine, and display and vary pseudo information on said display device as if said sewing machine is controlled based on said parametrical items in accordance with said main control program; and a central processing unit which executes one of said main-control program and sub-control program.

17. A control system according to claim 16, further comprising:

a communication interface though which said sewing machine is connected to said control system.

18. A control system according to claim 16, wherein said storage device includes a hard disk.

19. A control system according to claim 16, wherein said predetermined condition is a condition in which a connection flag CF is "0".

20. A storage medium which stores therein:

a simulation program, used for a control system connectable to a sewing machine, for virtually producing, in place of actual signals produced from said sewing machine, a plurality of pseudo signals required to execute a sewing operation of said sewing machine, and for displaying and varying pseudo information about said sewing operation on a display as if said sewing machine actually performs said sewing operation.

* * * * *